US010588806B2

(12) United States Patent
Brulotte et al.

(10) Patent No.: US 10,588,806 B2
(45) Date of Patent: Mar. 17, 2020

(54) COUPLED SPREADER BAR ASSEMBLY FOR PATIENT LIFT

(71) Applicant: ArjoHuntleigh Magog Inc., Magog (CA)

(72) Inventors: Denis-Alexandre Brulotte, Orford (CA); Martin Faucher, Magog (CA); François Arès, Sherbrooke (CA)

(73) Assignee: ArjoHuntleigh Magog Inc., Quebec (CA)

( * ) Notice: Subject to any disclaimer, the term of this patent is extended or adjusted under 35 U.S.C. 154(b) by 295 days.

(21) Appl. No.: 15/527,608

(22) PCT Filed: Nov. 17, 2015

(86) PCT No.: PCT/CA2015/051201
§ 371 (c)(1),
(2) Date: May 17, 2017

(87) PCT Pub. No.: WO2016/077924
PCT Pub. Date: May 26, 2016

(65) Prior Publication Data

US 2017/0360637 A1 Dec. 21, 2017

Related U.S. Application Data

(60) Provisional application No. 62/080,870, filed on Nov. 17, 2014.

(51) Int. Cl.
*A61G 7/10* (2006.01)

(52) U.S. Cl.
CPC ..... *A61G 7/1073* (2013.01); *A61G 7/1015* (2013.01); *A61G 7/1034* (2013.01);
(Continued)

(58) Field of Classification Search
CPC .. A61G 7/1034; A61G 7/1073; A61G 7/1015; A61G 7/1051; A61G 7/1042;
(Continued)

(56) References Cited

U.S. PATENT DOCUMENTS 846,079 A * 3/1907 Yost ..... F16C 3/035 464/167
1,411,569 A * 4/1922 Greene ..... A61G 7/1055 24/458

(Continued)

FOREIGN PATENT DOCUMENTS

EP 2901997 A1 8/2015

*Primary Examiner* — Nicholas F Polito
*Assistant Examiner* — Alexis Felix Lopez
(74) *Attorney, Agent, or Firm* — The Webb Law Firm

(57) ABSTRACT

A spreader bar assembly includes first and second spreader bars and a coupling member that extends between the two spreader bars and holds them together. The spreader bars are pivotally coupled to the connecting member and are able to pivot with respect to the connecting member in a single direction only. The connecting member may be a telescopic structure with a rod and cylinder and is able to extend and contract in length. Also, there may be rotation within the spreader bar, in the example, rotation of the rod within the cylinder. This enables the spreader bar assembly to accommodate loading differences from one side of a spreader bar to the other. The structure enables two spreader bars to be manipulated together, reducing the risk of injury to a patient or caregiver.

19 Claims, 6 Drawing Sheets

(52) U.S. Cl.
CPC ..... *A61G 7/1042* (2013.01); *A61G 7/1051* (2013.01); *A61G 7/1061* (2013.01); *A61G 2203/12* (2013.01)

(58) Field of Classification Search
CPC .... A61G 7/1061; A61G 2203/12; A47H 1/04; A47H 1/022; A47H 2001/0205
USPC ..... 5/83.1; 403/221, 222
See application file for complete search history.

(56) References Cited

U.S. PATENT DOCUMENTS 1,846,038 A * 2/1932 Owens ..... B66C 1/663 294/81.21
3,506,985 A * 4/1970 Lang ..... A61G 7/1015 5/85.1
4,190,912 A * 3/1980 Nilsson ..... A61G 7/1017 414/917
5,459,891 A * 10/1995 Reeve ..... A61G 7/1017 212/231
5,754,992 A * 5/1998 Melnick ..... A61G 7/1055 5/85.1
5,809,591 A * 9/1998 Capaldi ..... A61G 7/1015 5/83.1
6,505,969 B2 * 1/2003 Senger ..... F16C 3/035 384/56
7,182,301 B1 * 2/2007 Oddsen, Jr. ..... F16M 11/10 248/122.1
8,939,434 B2 * 1/2015 Selby ..... B66F 19/005 254/2 B
9,248,063 B2 * 2/2016 Wang ..... A61G 7/1003
9,421,140 B2 * 8/2016 Faucher ..... A61G 7/1015
2006/0026755 A1 2/2006 Bain et al.
2007/0240260 A1 * 10/2007 White ..... A61G 7/1017 5/81.1 R
2011/0239367 A1 * 10/2011 Gramkow ..... A61G 7/1015 5/83.1
2012/0152873 A1 * 6/2012 Didehvar ..... A47H 1/022 211/105.4
2012/0159706 A1 * 6/2012 Capaldi ..... A61G 7/1015 5/85.1
2012/0240334 A1 * 9/2012 Walker ..... A61G 7/1015 5/87.1
2013/0086793 A1 4/2013 Faucher et al.
2013/0284685 A1 * 10/2013 Lines-Pinckney ..... A47H 1/022 211/105.3
2014/0223660 A1 * 8/2014 Bolin ..... A61G 7/10 5/83.1
2014/0349772 A1 * 11/2014 Daenzer ..... F16D 3/065 464/167
2017/0319414 A1 * 11/2017 Arespong ..... A61G 7/1013
2018/0207042 A1 * 7/2018 Ringbjer ..... A61G 7/1055

* cited by examiner

COUPLED SPREADER BAR ASSEMBLY FOR PATIENT LIFT

CROSS-REFERENCE TO RELATED APPLICATIONS

This application is the United States national phase of International Application No. PCT/CA2015/051201 filed Nov. 17, 2015, and claims priority to U.S. Provisional Patent Application No. 62/080,870 filed Nov. 17, 2014, the disclosures of which are hereby incorporated in their entirety by reference.

TECHNICAL FIELD OF THE DISCLOSURE

The present disclosure relates to a spreader bar assembly for a ceiling lift tilt system and a patient ceiling lift system including a spreader bar assembly as taught herein.

BACKGROUND OF THE DISCLOSURE

Ceiling lifts for lifting and transporting patients have been in use for over twenty years. These types of patient lift are becoming more popular as they take up little space in a hospital or care home environment and are more efficient than floor lifts.

A ceiling lift can be described as a motor unit able to move along one or more rails arranged as a rail system, fixed to the ceiling. A flexible member such as a strap extends from the motor unit and is attached to a spreader bar. A patient sling or harness is attached to the spreader bar. An electrically motorized mechanism in the motor unit allows the user to extend or shorten the strap so as to raise or lower the spreader bar and with this to raise or lower the sling and any patient carried in the sling. The combination of rail system, motor unit, spreader bar and sling is often referred to as a ceiling lift system. Some ceiling lift systems are said to be fixed (the motor unit is dedicated to one room) while others are said to be portable (the motor unit can move around from room to room).

Over the last decades the size (weight & morphology) of patients has increased, causing manufacturers of ceiling lift systems to develop solutions that better address the handling challenges that larger patients pose. The initial response from manufacturers was to increase the lifting capacity of their existing products. Since then, patient handling techniques were developed, industry standards were established and user (patient and care givers) needs were better understood. It appears that there was room for devices which could do more than just having a greater lifting capacity and be able to transfer a patient in a fixed seated position. Indeed, users were in the need of a product with greater versatility.

One design adopted by manufacturers for handling patients of very large size (with a Body Mass Index above 40 or of weight above 160 kg, for example) has two motor units with two spreader bars which operate together. In one configuration, one of the motor units and its associated spreader bar supports/lifts the shoulder section of the patient, while the other motor unit and spreader bar supports/lifts the patient's leg section. A key benefit of such solution is the ability to provide a tilting function to sit or recline the patient during transfer, by creating a height difference between the spreader bars. Bringing the leg section spreader bar above the shoulder section spreader bar leads to a patient reclined position, while bringing the leg section spreader bar below the shoulder section spreader bar leads to a patient sitting position.

The tilting function increases patient comfort and reduces caregiver effort required to transfer a patient. Although this functionality can significantly improve patient comfort, it can lead, particularly for very large patients, to uncomfortable or hazardous situations.

The solution of using two spreader bars in the context of such a system can present, in some circumstances, a risk of user injuries, particularly of the user being hit by one of the spreader bars.

SUMMARY OF THE DISCLOSURE

The present disclosure seeks to provide an improved spreader bar assembly for a ceiling lift tilt system and to a ceiling lift system incorporating such a spreader bar assembly. According to an aspect of the present disclosure, there is provided a spreader bar assembly for a ceiling lift tilt system, including: first and second spreader bars, each in the form of a support element having first and second ends, a coupling element being provided at each end; and an extendable connecting structure connected between the spreader bars.

The connecting structure can assist in keeping the spreader bars together and enabling a care giver to manipulate them by holding just one of the spreader bars. In an illustrative embodiment, the extendable connecting structure is connected at a midpoint between the first and second ends of each spreader bar. In an advantageous non-limiting embodiment, the extendable connecting structure has bending rigidity. In practice, this can allow the assembly to be manipulated as a single component.

In an embodiment, the extendable connecting structure has high torsional rigidity. In another embodiment, the extendable connecting structure has low torsional rigidity.

In an illustrative embodiment, the extendable connecting structure is a telescopic bar arrangement formed of at least first and second telescopically arranged members. There is advantageously provided, in an illustrative embodiment, a low friction coupling between the first and second telescopic members. The low friction coupling may allow for low friction movement in a telescopically extending or contracting direction. For this purpose, the low friction coupling may include a plurality of rolling elements disposed in a transverse direction. The low friction coupling between the first and second telescopic members may, in some embodiments, allow for telescopic and rotational movement between the telescopic members. For this purpose, the low friction coupling may include a plurality of spherical rolling elements or a low friction dry bushing, for example.

In an illustrative embodiment, the first and second spreader bars are connected to the extendable connecting structure by hinged links. The hinged links can allow rotation of the spreader bars about the connecting structure in a first axis parallel to an axis between the first and second ends of each spreader bar. The first axis may be a horizontal axis, in which case the spreader bars can pivot or rotate vertically.

In an embodiment, the hinged links prevent rotation of the spreader bars about an axis perpendicular to a second axis between the first and second ends of each spreader bar. The second axis is, in an embodiment, a vertical axis, in which case the spreader bars cannot pivot or rotate horizontally relative to the connecting structure and one another. Advantageously, according to an embodiment, the first and second spreader bars are connected to the connecting structure in a manner preventing or limiting twisting of the spreader bars in a plane in which the spreader bars lie.

In another embodiment, a spreader bar assembly for a ceiling lift tilt system, includes a first and second spreader bars, each configured as a support element having first and second ends, a coupling element being provided at each end; and a rigid connector extending between and connecting the first and second spreader bars, wherein the connector secures the first and second spreader bars to one another so as to substantially restrict independent rotational movement of the spreader bars with respect to one another in at least one direction.

According to another aspect of the present disclosure, there is provided a patient ceiling lift system including: first and second motor units; first and second flexible strap elements each coupled to a respective one of the first and second motor units, wherein each motor unit is operable to change an operative length of its associated strap element by extending or retracting the strap out of or into the motor unit, each strap element including a coupling for attachment to a patient sling; and a spreader bar assembly including first and second spreader bars, each in the form of a support element having first and second ends, wherein a coupling element is provided at each end, and an extendable connecting structure connected between the spreader bars.

In accordance with an embodiment, the extendable connecting structure is connected at a midpoint between the first and second ends of each spreader bar and is a telescopic bar arrangement formed of at least first and second telescopically arranged members.

Advantageously, in an illustrative embodiment, the first and second spreader bars are connected to the extendable connecting structure by hinged links allowing rotation of the spreader bars about the connecting structure in a first axis parallel to an axis between the first and second ends of each spreader bar and preventing rotation of the spreader bars about an axis perpendicular thereto. It is to be understood that the motor units are preferably but not necessarily separate components. They may in some instances share a common casing, in which each motor unit will include a motor and a drum, which are independently operable relative to one another.

Illustrative embodiments provide a spreader bar assembly, which includes first and second spreader bars and a coupling member, which extends between the two spreader bars and holds them together. The spreader bars are pivotally coupled to the connecting member and are able to pivot with respect to the connecting member in a single direction only. The connecting member is, in an embodiment, a telescopic structure with a rod and cylinder and is able to extend and contract in length. It is preferred also that the rod and cylinder of the spreader bar can rotate relative to one another, which enables the spreader bar assembly to accommodate loading differences from one side of a spreader bar to the other. The structure enables two spreader bars to be manipulated together, reducing the risk of injury to a patient or caregiver.

Other features and aspects of the disclosure herein will become apparent from the disclosure of illustrative embodiments, which follows.

BRIEF DESCRIPTION OF THE DRAWINGS

Embodiments of the present invention are described below, by way of example only, with reference to the accompanying drawings, in which.

DESCRIPTION OF THE ILLUSTRATIVE EMBODIMENTS

Figure 1:
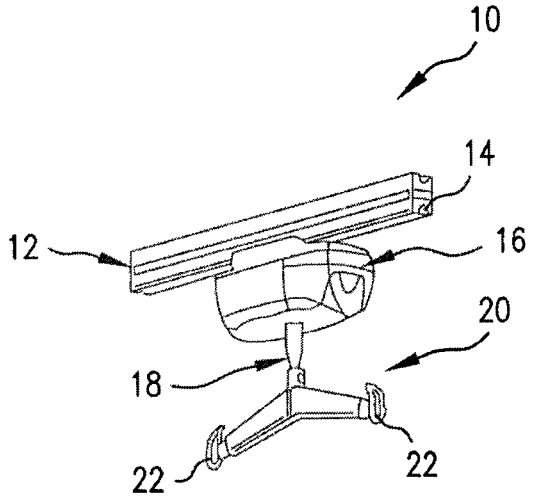
FIGS. 1 and 2 show an example of a prior art ceiling lift system, spreader bar and sling.

Referring first to FIG. 1, this shows a conventional ceiling lift system 10 which includes a rail 12 that is fixed to the ceiling structure of a patient care facility, such as a hospital, care home or the like. The rail 12 includes a downwardly depending channel 14. The system 10 may include a transmission, winding or coiling assembly, having for example a motor unit 16 which includes a wheel or roller (not shown) which runs within the downwardly depending channel 14 to allow the motor unit 16 to be moved in supported manner along the rail 12, as is known in the art.

Figure 2:
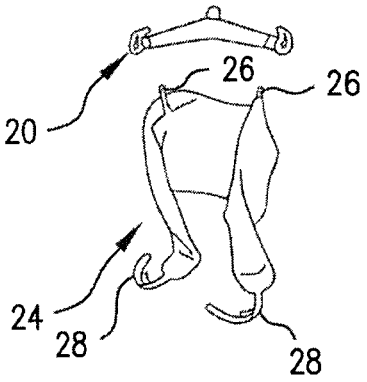

The motor unit 16 is operatively associated with, coupled to and/or includes a tensile support member, such as a flexible element or strap 18, which in practice is attached to a motorised spool or drum within the motor unit 16, and which can be unwound from the spool to lengthen the strap 18 and wound on the spool to shorten the strap 18, again in known manner. One skilled in the art would appreciate that one or more or any number of tensile support members may be operatively associated with, coupled to and/or form part of a motor unit to facilitate patient support. In one embodiment, the tensile support member is configured to be coilable about the drum or motorized spool of motor unit 16 and having sufficient tensile strength for lifting a patient. In an exemplary embodiment, the support member may be rigid in tension along its length yet permit motion in other directions to dynamically support a patient, inclusive of bariatric patients. Exemplary support members may include webbing, belts, rope, wire, cord, cable and chains. The strap 18 includes a coupler at its lower, free end, to which there can be attached a spreader bar 20, again of known form. The coupling can be any fastener, connector, attachment or securement mechanism suitable for connection to spreader bar 20. The spreader bar 20 includes coupling points 22, which are spaced from one another and specifically at either end of the bar 20. The coupling points 22 act as attachments for a sling 24, as shown in FIG. 2. The sling 24 is provided with a plurality of straps 26, 28, which attach to the coupling points 22 so that the sling 24 is held by the spreader bar 20 in an open condition to support a patient comfortably in the sling 24. These slings are well known in the art.

Figure 3:
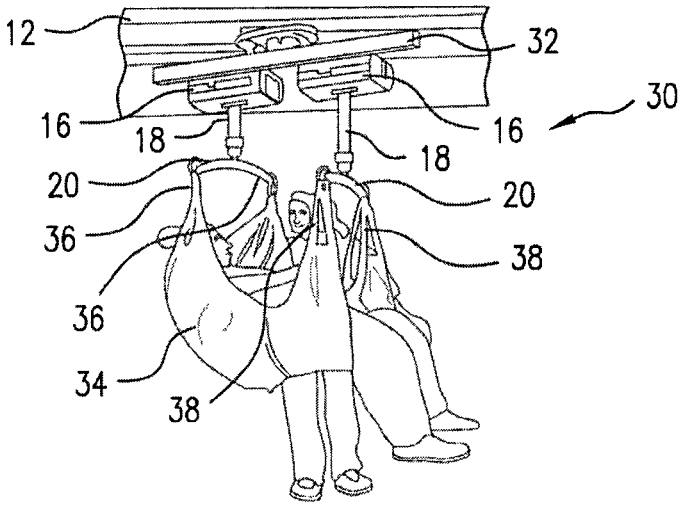
FIG. 3 shows an example of a double motor ceiling lift system.

While a system as shown in FIGS. 1 and 2 is suitable for lifting and transporting patients up to moderate sizes, heavier or larger patients cannot be carried by a simple system of this nature. In this regard, the apparatus of FIG. 3 is generally used. The apparatus 30 includes two motor units 16, which are attached to a support unit 32, which is coupled to the rail 12 (compare with the example of FIG. 1). The apparatus 30 includes two spreader bars 20, each attached to a respective strap 18 of a respective motor unit 16. The motor units 16 are spaced from one another so that one strap 18 and its associated spreader bar 20 can be located around the top of the patient's torso, whereas the other motor unit and spreader bar 20 is located around the patient's thigh position. A sling 34 includes pairs of straps 36, 38 coupling to respective spreader bars 20, which allow a patient to be held within the sling 34 in a gently reclining position as shown in the example of FIG. 3.

The motor units 16 are operable to wind and unwind lengths of strap 18 such that the spreader bars 20 can be raised or lowered as required. For instance, the straps 18 can be lengthened to lower the spreader bars 20 towards a patient reclining on a bed and then wound into the motor units 16 to raise the spreader bars 20 and thus to raise the patient while carried in the sling 34. The motor units 18 are, for this purpose, controlled by a caregiver such as nurse, and are advantageously movable independently of one another so that the patient can be moved to different positions while suspended in the sling 34. For example, the patient can be held in a substantially reclining position as shown in FIG. 3 or could be raised to a sitting position, by raising the spreader bar 20 at the torso end of the patient.

The use of two spreader bars 20 can, in some instances, hurt or injure the user. For example, when the caregiver is trying to attach the patient sling to the spreader bars, it is a challenge to keep control over both spreader bars while at the same time operating the ceiling lift system. This can result in the second spreader bar hitting the patient or the caregiver. Moreover, when initiating a patient lift operation, it has been observed that in some cases' the load (direction and magnitude) supported by each hook of the leg spreader bar may be uneven, which can lead to uncontrolled movement if left unattended, particularly of rotation of the spreader bar around the vertical axis passing through the strap, which connects the spreader bar to the associated motor unit. This can cause the spreader bar to hit the caregiver or patient.

Figure 4:
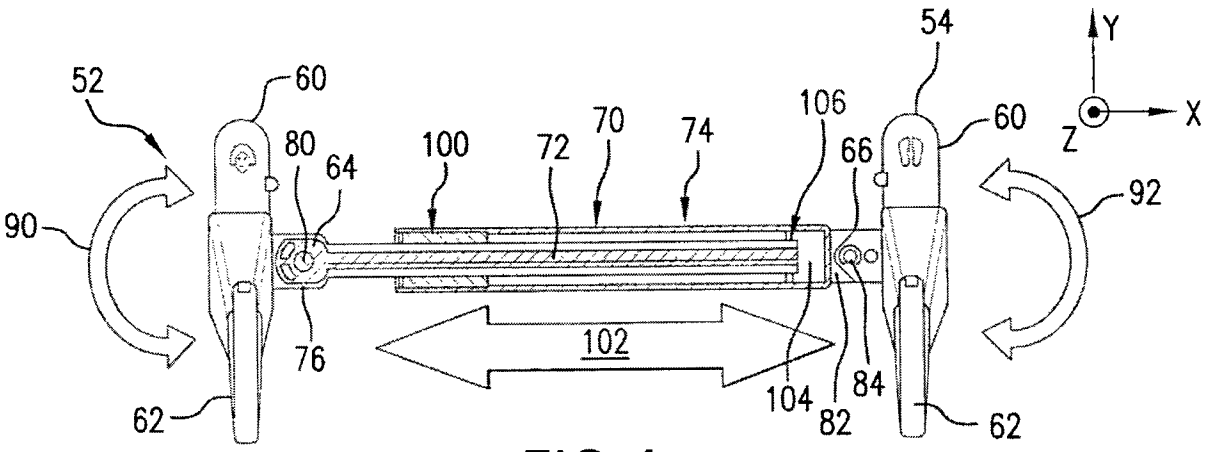
FIG. 4 is a side elevational view of an illustrative embodiment of a spreader bar assembly.

Referring now to FIG. 4, this shows an embodiment of spreader bar assembly according to the teachings herein. FIG. 4 shows a view of the spreader bar assembly 50 with a connecting structure shown in partial cross-section and an end view of the two spreader bars. The assembly 50 includes a head-end spreader bar 52 and a foot-end spreader bar 54. These can have a structure similar to the spreader bar 20 shown in FIGS. 1 to 3, in particular, being in the form of a yoke having two arms which extend downwardly at a gentle angle from the centre point, with a connecting element 60 extending upwardly from the centre point at the apex of the two arms. The connecting element 60 allows for connection to a strap of a motorised unit, as is known in the art. At the end of each arm there is a connecting element, which may be a hook 62, on to which a strap or webbing of a sling can be attached, again in conventional manner. Each spreader bar 52, 54 may typically be made of a metal or metal alloy for strength.

Figure 6:
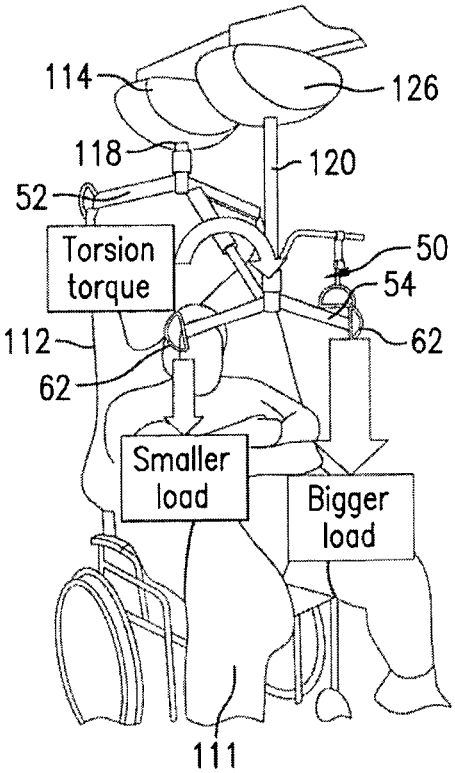

Projecting horizontally from each spreader bar is a hinge coupling 64, 66, which in one embodiment may comprise two spaced sideways extending flanges having a pair of holes therein for receiving a hinge rod or pin. Disposed between and connecting the two spreader bars 52, 54 together is a connector 70 which secures the spreader bars 52, 54 to one another and substantially prevents torsion and rotation of the spreader bars 52, 54 with respect to one another and with respect to the longitudinal axis of connector 70 in the direction best shown in FIG. 9. This may be accomplished, for example, by rigidly fixing spreader bars 52, 58 to one end of hinge couplings 64, 66 while a second end of hinge couplings 64, 66 may be configured to allow for only one or two degrees of rotational freedom with respect to an end of connector 70. In an exemplary embodiment, each of spreader bars 52, 54 is attached to and extends from rigid connector 70 in a manner such that the body and/or length of spreader bars 52, 54 are maintained in a substantially parallel orientation relative to one another, irrespective of movement or repositioning of any one of the spreader bars 52, 54 or the spreader bar assembly 50. The body of spreader bars 52, 54 may be situated and aligned in parallel planes relative to one another and move in tandem in at least one direction. While spreader bars 52, 54 may be spaced apart and vertically offset from one another as permitted by hinge coupling 64, 66 and as illustrated in FIG. 6, rigid connector 70 and/or hinge couplings 64, 66 may substantially prevent spreader bars 52, 54 from rotating horizontally towards or away from one another in a horizontal plane. Rotational movement of spreader bars 52, 54 about a vertical axis of the spreader bars 52, 54 may be limited to about 10 degrees or less, about 5 to about 10 degrees or about 5 degrees or less. The rigidity of connector 70 and the connection between connector 70 and spreader bars 52, 54, as established by hinge coupling 64, 66, restrains the independent movement of the spreader bars 52, 54 with respect to one another in at least one direction, thereby allowing for synchronized and correlated directional positioning of a patient's head and foot regions when supported by the sling. This constraint on rotational freedom facilitates and simplifies positioning of the lift's spreader bars 52, 54, allowing for centralized control and direction of both spreader bars 52, 54 in a horizontal direction as well as enabling a user to manually control the orientation and arrangement of both spreader bars 52, 54 with one hand merely by holding onto and directing movement of the lift system with connector 70. This feature further reduces the incidence of accidents caused by the unintentional, independent, uncontrolled movement of a spreader bar. In an exemplary embodiment, the connector may be configured as an extendable connection structure 70, which in this embodiment is a telescopic member having a piston or rod element 72, which is able to slide within a cylinder element 74. The rod element 72 has at its free end a coupling member 76 that couples to the hinge joint 64 of the spreader bar 52 and that could, for example, be formed with two parallel side walls with a bore therein which aligns with the holes in the flanges 64 for receiving the hinge bolt 80.

The cylinder element 74 has a similar hinge coupling 82 at the end opposite that of the rod 72 and which may have a similar structure and arrangement as the coupling 76 of the rod element 72, for receiving hinge bolt 84. In this manner, the spreader bars 52, 54 are connected to the connecting structure 70 in such a manner that the spreader bars can pivot around their respective hinge joints in the direction of the arrows 90 and 92. This allows the spreader bars 52, 54 to be disposed at different heights as will be explained below in further detail.

The telescopic connector structure 70 also includes a bushing 100 which holds the cylinder 74 to the rod 72 and in a manner in which the rod 72 can at least slide longitudinally within the cylinder 74, in the longitudinal direction of the connecting element 70. In illustrative embodiments, the rod 72 can also rotate within the cylinder 74, as described in further detail below. Longitudinal displacement is shown by the arrow 102.

The cylinder 74 may include an end stop 104 to limit the extent to which the rod 72 can be pushed into the cylinder 70, and which may usefully be made of a rubber or elastomeric material. There is also provided a stop ring or washer 106 attached to the distal end of the rod or shaft 72, and which in practice prevents the shaft 72 from being pulled completely out of the cylinder element 74. This could usefully be fixed to the end of the rod 70 by a suitable circumferential groove in the rod, by pins or by any other mechanism or bonding.

In the configuration shown in FIG. 4, the spreader bar assembly 50 can be said to be in its contracted condition, with the two spreader bars 52, 54 as close to one another as possible.

The structure of connector element 70 allows the distance between the two spreader bars 52 and 54 to be increased in the horizontal direction, along the X axis as depicted in FIG. 4, to accommodate the morphology of very large patients. This is achieved by allowing the rod 72 to slide linearly in the bushing 100 and out of the cylinder 72, until the shaft stop 106 comes into abutment against the bushing 100.

All of the components of the connecting element 70, that is the cylinder 74, the bushing 100 and the rod 72, are, in an embodiment, all of circular cylindrical shape. The rod 72 can be made from anodized aluminium and the bushing 100 of a polymer in order to minimise friction. The low friction coupling between the rod 72 and the cylinder 74 allows the connector 70 to lengthen and shorten readily by external influences, such as forces generated by the lifting motors, the size of the sling attached to the spreader bar assembly 50, the size of the patient and so on. It also enables the caregiver to alter the distance between the spreader bars 52, 54 readily in order to accommodate different size patients and different sling sizes.

The angle of pivot or tilt of the spreader bars 52, 54 relative to the connecting member 70 is, in an embodiment, limited in order to avoid the risk of a user trapping his or her fingers between the spreader bar and the connecting member. Suitable stop elements to restrict the angle of tilt will be readily apparent to the person skilled in the art. The ability of the spreader bars 52 and 54 to rotate around the X axis ensures that torsion torque is not transmitted through the connecting member 70 between the two spreader bars 52, 54, which may be generated during uneven loading on one or both of the spreader bars.

Figure 5:
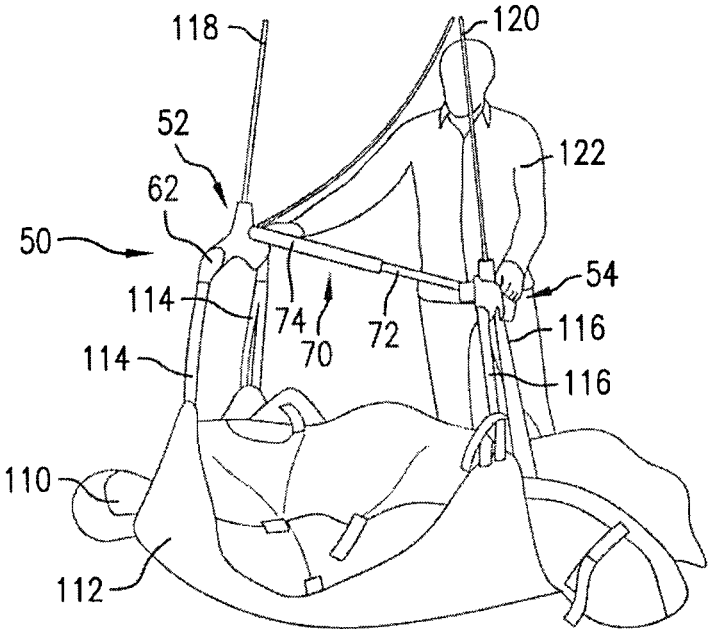
FIGS. 5 to 7 illustrate the spreader bar assembly of FIG. 4 in different states of operation.

Referring now to FIG. 5, this shows a first example of usage of the spreader bar assembly 50 in lifting a patient 110 suspended in a sling 112. The sling 112 has two pairs of strap elements 114, 116, which are attached to respective hooks 62 of the two spreader bars 52, 54, in conventional manner. Each spreader bar is attached to a strap 118, 120 of a respective motor unit (not visible in FIG. 5) for raising and lowering the spreader bar assembly 52 and, as a result, the sling 112 and patient 110. As will be apparent in FIG. 5, the connecting element 70 has extended in length with the rod 72 being withdrawn from the cylinder 74, in this example, up to the point at which the shaft stop 106 comes into abutment with the bushing 100 of the assembly 70 and, thus, at its maximum extended condition. The spreader bars 52, 54 are thus at their greatest distance apart.

Furthermore, the head end spreader bar 52 is at a greater height relative to the foot spreader bar 54, made possible by the fact that the connecting structure 70 is pivotally connected to the spreader bars 52, 54, as explained above in connection with FIG. 4. The spreader bar assembly 50 can, therefore, adopt a tilted configuration.

The operator 122 is able to manipulate the assembly 50 by handling just one of the spreader bars 52, 54, with the coupling element 70 causing the spreader bars 52, 54 to act as a single unit and as a result to stop any independent movement or inadvertent swinging of the other spreader bar, which might hit the caregiver 122 or patient 110.

FIG. 6 shows another example usage of the spreader bar assembly 50, in this instance for supporting a patient 111 in a seating position. In order to achieve this, the spreader bar 52 at the head end of the patient is raised, by winding the strap 118 into its associated motor unit 124 (in known manner) and in extending strap 120 by unwinding it from the drum of its respective motor unit 126, to create a significant height difference between the two spreader bars 52 and 54. As can be seen, the connecting element 70 keeps the spreader bars connected together and is able to extend and pivot relative to the spreader bars 52, 54 in order to allow this offset in height differences.

FIG. 6 also shows the effect of torsion forces applied to the spreader bar 54 as a result of uneven loading on the two arms and, in particular, at the hooks 62 of the spreader bar 54. As explained above, in the illustrative embodiment of the apparatus 50, the rod 72 is able to rotate within the cylinder 70 so as to allow relative rotation of the spreader bars 52, 54 around the longitudinal axis of the connecting member 70, so as to accommodate uneven loads. This enables the spreader bars 52 and 54 of the assembly 50 to act in terms of accommodating torsional forces as they would if they were separate devices.

Figure 7:
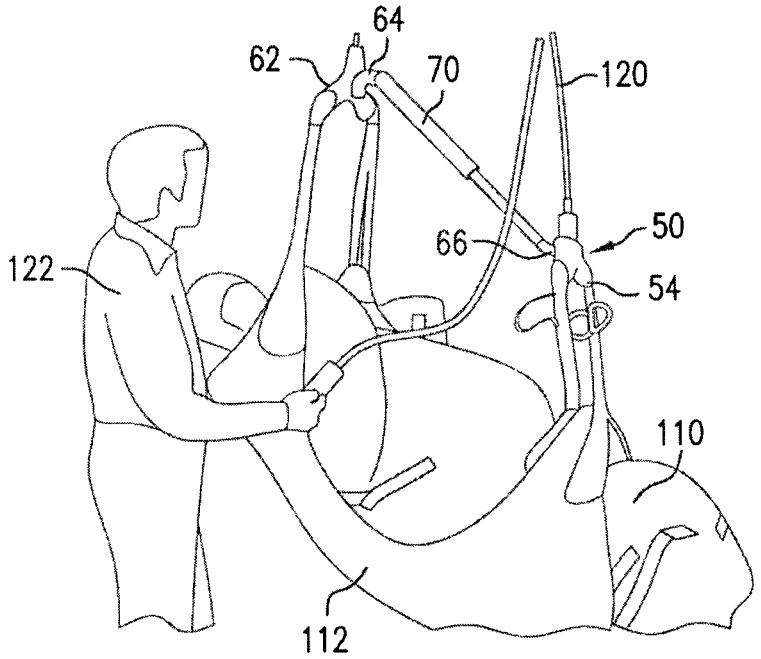

Referring now to FIG. 7, this shows another example of usage of the spreader bar assembly 50 to support a patient 110 in a seating position in a sling 112. The head end spreader bar 52 is at a significantly greater height than the foot end spreader bar 54, enabled by the hinged connections 64, 66 between the spreader bars 52, 54 and the connecting member 70. The connecting member 70 is in its most elongate configuration in FIG. 7.

Figure 8:
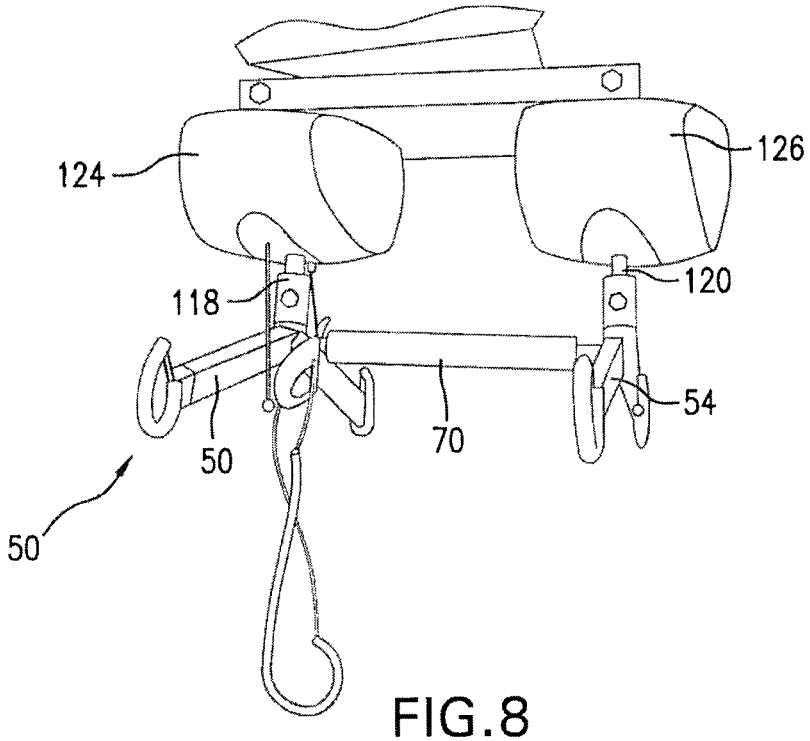
FIG. 8 is a view of a ceiling lift assembly with the spreader bar assembly in a storage configuration.

Referring now to FIG. 8, this shows an example configuration in which the spreader bar assembly 50 is in a storage configuration and specifically raised towards the ceiling motors 124, 126 (by appropriate winding of the straps 118, 120) so that the spreader bar assembly 50 is located close to ceiling height and out of the way of care workers and patients. The connecting member 70 is in its most compact form, with the rod 70 pushed all the way into the cylinder 74, in the manner shown in FIG. 4. As explained above, this can occur without any external driving mechanism as a result of the low friction bushing 100 and simply by the force which would be generated on winding the straps 118, 120 into the motor unit 124, 126 and the linearly compressive force that these would eventually apply to the two spreader bars 52, 54 to which they are attached.

Figure 9:
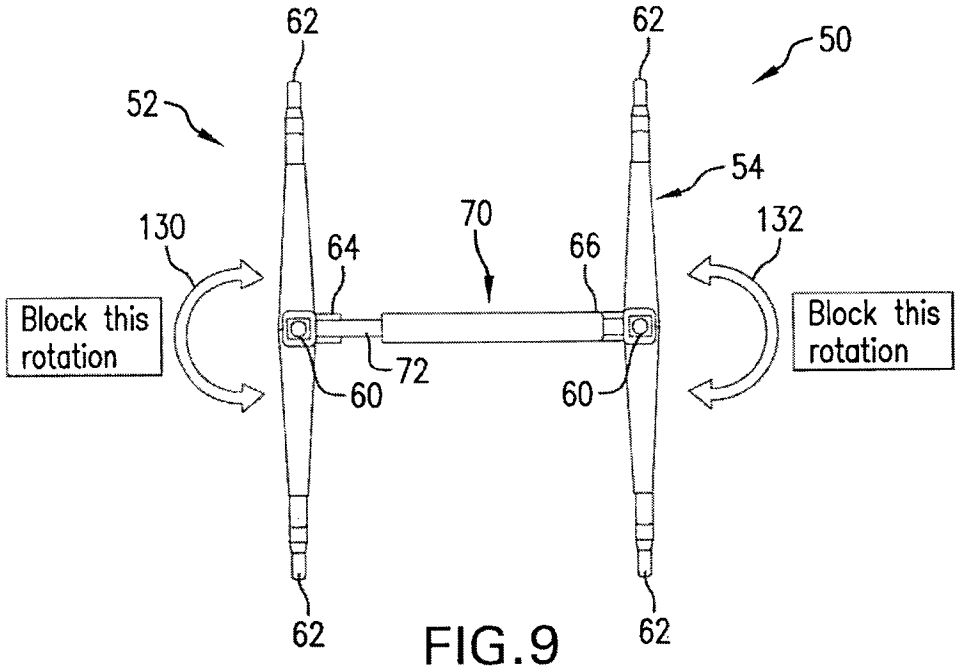
FIG. 9 is a schematic plan elevational view of the spreader bar assembly of FIG. 4.

FIG. 9 shows the spreader bar assembly of FIG. 4 in plan view, as in practice will be seen looking down from the ceiling towards the spreader bar assembly 50. As with the configuration shown in FIG. 4, the spreader bar assembly 50 is in its most compact form, with the connecting structure 70 linearly compacted and the spreader bars 52, 54 in their most close configuration. The hinge elements 64, 66 of the assembly 50, as described in FIG. 4, provide for rotation of the spreader bars 52, 54 around the hinge pins 80, 84 and in the view of FIG. 9 in the plane of the paper. The hinge assembly 64, 66, however, block any rotation of the spreader bars 52, 54 in a direction orthogonal to that and in particular in a direction which would cause the spreader bars 52, 54 to adopt any configuration other than being parallel to one another. In particular, rotation of the spreader bars 52, 54 in the plane of the paper and depicted by the arrows 130, 132 is blocked. This could usefully be described as blocking or preventing rotation about a vertical axis (the Y axis of FIG. 4) passing through the connecting member 60 that connect the spreader bars to the straps 118, 120. This arrangement prevents uncontrolled movement of the spreader bars 52, 54 about the Y axis. This also ensures that the spreader bar assembly 50 can be easily manipulated by a caregiver.

Figure 10:
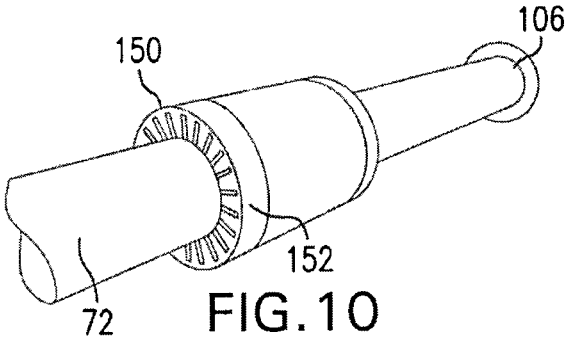
FIGS. 10 to 12 are different embodiments of a telescopic connecting structure of the spreader bar assembly of FIG. 4.

Referring now to FIG. 10, this shows one example for the bushing 100 of the connecting structure 70, which is typically located within the cylinder 74. The bushing 150 of FIG. 10 is a dry bushing, typically made of a polymer material so as to have a low coefficient of friction with the shaft or rod 72. Thus, the rod 72 can slide easily within the bushing 150 and also rotate therewithin. The bushing 150 can be a solid cylinder or, as shown, could have radially inwardly extending fins 152. The provision of fins 152 reduces the surface area contact of the bushing 150 with the rod 72 and as a result further reduces friction.

Figure 11:
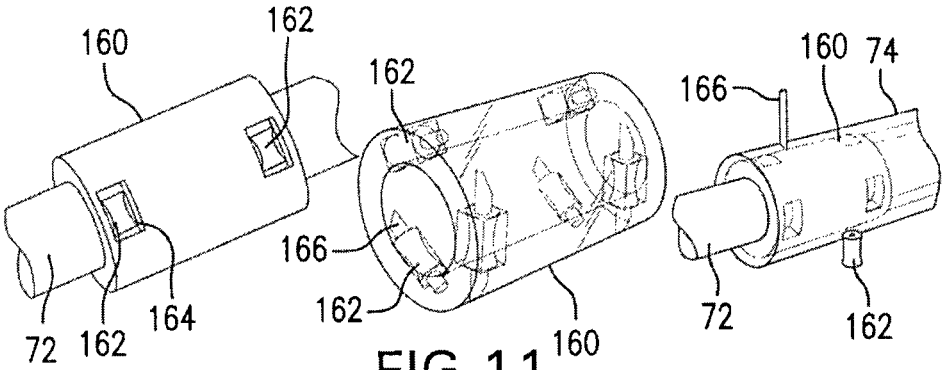

Referring now to FIG. 11, this shows a fixed roller bearing 160, which can be used as the bushing 100 of the connecting member 70 for the spreader bar assembly 50. The roller bushing 160 includes a series of rollers 162 that are disposed to have their axes extend transversely of the bushing 60, that is in a direction normal to the longitudinal dimension of the bushing. The rollers 162 usefully have a waisted shape with a radius of curvature of the waist consistent with the radius of curvature of the rod 72, so that they are in contact with the rod 72 over their operating length. As will be apparent from the middle sketch of FIG. 11, there may be provided a plurality of roller bearings 162, in this example arranged in two sets of three roller bearings 162 each, with the roller bearings of each set arranged at equally spaced circumferential intervals around the casing 160. Each roller 162 is disposed within a suitable aperture 164 of the bearing casing 160 and may be held to the casing by bearing shafts 166, as shown.

It will be appreciated that the bearing 160 allows free, that is low friction, sliding of the rod 72 within the bushing 60 and, therefore, in and out of the cylinder 74. The friction between the rollers 162 and shaft or rod 72 is preferably low enough to allow rotation, but high enough to provide for rolling of the rollers 162 during contraction/extension of the rod 72. It is not excluded, though, that high friction rollers 162 could be used in some embodiments.

Figure 12:
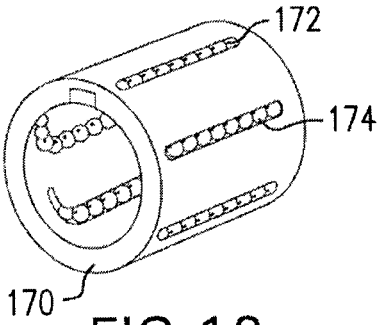

Referring now to FIG. 12, this shows another example of bushing 170, which can be used as the bushing 100 in the assembly of FIG. 4. The bushing 170 includes a bushing sleeve having a plurality of elongate slots 172 therein and a series of ball bearings 174 disposed within the slots. The elongate slots could have rounded side walls to hold the ball bearings therewithin, as will be apparent to the skilled person. The ball bearings 172 extend just beyond the perimeter of the inner surface of the sleeve 170 so as to contact the rod 72 but are spaced from the outer surface of the sleeve 170 so as to be spaced from the inner surface of the cylinder 74. The roller bearings are able to roll in any direction, thereby providing a low friction coupling of the rod 72 to the cylinder 74 in any direction, providing for low friction sliding and rotation of the rod 72 relative to the cylinder 74.

The skilled person will appreciate that the bushing 100 could, in other embodiments, be disposed in abutment with and attached to the end of the cylinder 74, rather than being within the cylinder.

All optional and preferred features and modifications of the described embodiments are usable in all aspects of the disclosure taught herein. Furthermore, the individual features of the various embodiments, as well as all optional and preferred features and modifications of the described embodiments, are combinable and interchangeable with one another.

The disclosure in the abstract accompanying this application is incorporated to herein by reference.

While systems, apparatuses and methods have been described with reference to certain embodiments within this disclosure, one of ordinary skill in the art will recognize, that additions, deletions, substitutions and improvements can be made while remaining within the scope and spirit of the invention as defined by the appended claims.

We claim:

1. A spreader bar assembly for a ceiling lift tilt system, comprising:

first and second spreader bars, each configured as a support element having first and second ends, each spreader bar comprising:

a coupling element being provided at each end;

a connection element extending upward from a center point of the spreader bar; and a hinge coupling; and a telescopically extendable rigid connector extending between and connecting the hinge couplings of the first and second spreader bars, wherein the connector secures the first and second spreader bars to one another so as to substantially restrict independent rotational movement of the spreader bars with respect to one another in at least one direction.

2. The spreader bar assembly according to claim 1, wherein at least one spreader bar is restricted from rotating about a vertical axis of the connector by 10 degrees or less.

3. The spreader bar assembly according to claim 1, wherein the first and second spreader bars are oriented parallel to one another and move in tandem in at least one direction.

4. The spreader bar assembly according to claim 1, wherein the rigid connector is connected at a midpoint between the first and second ends of each of the first and second spreader bars.

5. The spreader bar assembly according to claim 1, wherein the rigid connector has bending rigidity.

6. The spreader bar assembly according to claim 1, wherein the rigid connector has low torsional rigidity.

7. The spreader bar assembly according to claim 1, wherein the rigid connector has high torsional rigidity.

8. The spreader bar assembly according to claim 1, wherein the rigid connector comprises at least first and second telescopically arranged members and a low friction coupling between the first and second telescopic members, and wherein the low friction coupling between the first and second telescopic members allows for low friction movement in a telescopically extending or contracting direction.

9. The spreader bar assembly according to claim 8, wherein the low friction coupling comprises a plurality of rolling elements disposed in a transverse direction.

10. The spreader bar assembly according to claim 8, wherein the low friction coupling between the first and second telescopic members allows for rotational movement between the telescopic members.

11. The spreader bar assembly according to claim 10, wherein the low friction coupling comprises a plurality of spherical rolling elements or a low friction dry bushing.

12. The spreader bar assembly according to claim 1, wherein the hinge couplings allow rotation of the first and second spreader bars about the connecting structure in a first axis parallel to an axis between the first and second ends of each of the first and second spreader bar.

13. The spreader bar assembly according to claim 12, wherein the first axis is a horizontal axis.

14. The spreader bar assembly according to claim 1, wherein the hinge couplings prevent rotation of the first and second spreader bars about an axis perpendicular to a vertical axis between the first and second ends of each spreader bar.

15. The spreader bar assembly according to claim 1, wherein the first and second spreader bars are connected to the rigid connector to prevent or limit twisting of the first and second spreader bars in a plane in which the first and second spreader bars lie.

16. The spreader bar assembly according to claim 1, further comprising a hinge fixedly extending from each of the first and second spreader bars and attached to the connector to permit no more than one degree of rotational freedom.

17. A spreader bar assembly for a ceiling lift tilt system, comprising:

first and second spreader bars, each configured as a support element having first and second ends, each spreader bar comprising:

a coupling element being provided at each end;

a connection element extending upward from a center point of the spreader bar; and a hinge coupling; and a telescopically extendable connecting structure connected between the hinge couplings of the spreader bars.

18. A patient ceiling lift system comprising:

first and second motor units;

first and second tensile support members each coupled to a respective one of the first and second motor units, each motor unit being operable to change an operative length of its associated strap element by extending or retracting the strap out of or into the motor unit, each strap element comprising a coupling for attachment to a patient sling; and a spreader bar assembly comprising first and second spreader bars, each in the form of a support element having first and second ends, each spreader bar comprising:

a coupling element being provided at each end, a connection element extending upward from a center point of the spreader bar; and a hinge coupling, and an extendable connecting structure connected between the hinge couplings of the first and second spreader bars.

19. The system according to claim 18, wherein the first and second spreader bars are connected to the extendable connecting structure so as to allow rotation of the spreader bars about the connecting structure in a first axis parallel to an axis between the first and second ends of each spreader bar and preventing rotation of the first and second spreader bars about an axis perpendicular thereto.

* * * * *